US008251732B2

(12) United States Patent
Armacost et al.

(10) Patent No.: US 8,251,732 B2
(45) Date of Patent: Aug. 28, 2012

(54) POWER INPUT ELECTRICAL CONNECTOR

(75) Inventors: David Armacost, Leawood, KS (US); Kevin Cornelius, Lee's Summit, MO (US); Wesley Fueston, Bates City, MO (US)

(73) Assignee: Maxi-Seal Harness Systems Inc., Grandview, MO (US)

( * ) Notice: Subject to any disclaimer, the term of this patent is extended or adjusted under 35 U.S.C. 154(b) by 0 days.

(21) Appl. No.: 13/169,940

(22) Filed: Jun. 27, 2011

(65) Prior Publication Data

US 2011/0318951 A1 Dec. 29, 2011

Related U.S. Application Data

(60) Provisional application No. 61/359,189, filed on Jun. 28, 2010.

(51) Int. Cl.
*H01R 13/625* (2006.01)

(52) U.S. Cl. ..... 439/347; 439/533; 439/903

(58) Field of Classification Search ..... 439/35, 439/332–335, 345, 347, 527, 533, 903
See application file for complete search history.

(56) References Cited

U.S. PATENT DOCUMENTS

| | | | | |
|---|---|---|---|---|
| 5,224,874 | A | 7/1993 | Sell | |
| 5,443,389 | A | 8/1995 | Hughes | |
| 5,564,947 | A | 10/1996 | Ingles | |
| 6,162,085 | A | 12/2000 | Chugh et al. | |
| 6,338,644 | B1 | 1/2002 | Fritzinger et al. | |
| 6,450,833 | B1 | 9/2002 | Brown, Jr. et al. | |
| 6,554,626 | B2 | 4/2003 | Ramos, Jr. | |
| 6,743,025 | B2 | 6/2004 | Howard | |
| 7,097,469 | B2 | 8/2006 | Jacobs | |
| 7,575,450 | B2 | 8/2009 | Williams et al. | |
| 7,878,866 | B1 * | 2/2011 | Kwasny et al. | 439/695 |
| 7,918,675 | B2 * | 4/2011 | Van Den Meersschaut et al. | 439/157 |
| 8,038,462 | B2 * | 10/2011 | Svelnis et al. | 439/347 |

* cited by examiner

*Primary Examiner* — Khiem Nguyen
(74) *Attorney, Agent, or Firm* — Polsinelli Shughart PC; Richard P. Stitt

(57) ABSTRACT

A wiring harness electrical connector is provided having a detachable and re-attachable mounting system to permit the attachment of the connector on a frame surface of a semi-trailer, or workpiece, from the rear or interior side of the of the frame or workpiece without disruption to the integrally formed and moisture proof encasing of the connector.

7 Claims, 5 Drawing Sheets

POWER INPUT ELECTRICAL CONNECTOR

CROSS REFERENCE TO RELATED APPLICATIONS

This application claims priority to U.S. Provisional Application No. 61/359,189 filed Jun. 28, 2010 and titled Power Input Electrical Connector.

FIELD OF THE INVENTION

This application relates to the field electrical connectors. More particularly, this application relates to connectors used to connect the electrical wiring harnesses of over-the-road trailers, and in particular, trailers connected in double trailer arrangement.

BACKGROUND OF THE INVENTION

Semi-trailer tractor trucks also known as a semi, or tractor-trailer, will frequently be configured to tow a second semi-trailer behind the first in a configuration known as a "double trailer". In such a configuration it is necessary that the tail lamps, running lamps, brake lights, and signal lights of the towed trailer be connected into the tractor so proper illumination and turn and brake signals are operating on the rear-most trailer. This is typically accomplished by providing a wiring harness that travels the length of the first trailer to communicate electrical signals generated by the tractor to the rear-most trailer. The wiring harness allows the rear-most trailer to be connected into the electrical system of the tractor thereby receiving the electrical impulses that cause illumination of the tail lamps, running lamps, brake lights, and signal lights of the towed trailer. The wiring harness must be affixed to the trailer and at the front and/or rear of the trailer. The end terminal or socket of the wiring harness must be installed into a portion of the frame of the trailer. Generally, such installation comprises the placement of the receptacle or socket (typically known as an SAE standard J560 connector) within a round hole or void that has been made in a front or rear metal frame piece of the trailer. It will be appreciated that a first end of the wiring harness has an electrical connector located in an opening on the forward facing surface of the trailer, (or work-piece) and is commonly referred to as the "Nose Plug." A second electrical connector is located in an opening on the rearward facing surface of the trailer and may be referred to as the "Tail Plug." Both plugs or receptacle or sockets are defined in SAE specification J560. The connector at the rear of the trailer is suitable for connecting another tandem trailer and serves as the power output connector to the trailer in-tow or dolly in-tow.

The challenge in trailer wiring is ensuring a waterproof seal at the trailer's power connector. The electrical connector is exposed to all forms of weather and highway driving speeds and vibrations. This environment and these conditions make it essential that any connector be sealed against the elements and that the integrity of such sealing against the elements be maintained during installation to avoid corrosion of the connector and wiring harness. Generally, this requirement for excluding moisture and dirt has resulted in wiring harnesses that are fully formed with integral receptacles or socket and with molded plastic covers that extend the length of the wiring harness and the receptacles. Therefore, installation of a wiring harness requires either insertion of one end of the harness through a mounting hole in the trailer frame and pulling the 30 to 60 feet of wire through the hole or having a connector that can be mounted in the hole from the back-side of the hole. The first of these installation methods can result in the scraping and cutting of the wiring harness on the edges of the metal in which the hole or void is made.

Therefore, it would be beneficial to have a receptacle or socket that allows for rear installation of the socket onto the trailer frame to avoid pulling the whole of the wiring harness through the hole in the trailer frame. It would be a further benefit if the socket is integrally sealed against moisture with the wires or electrical leads that are attached to the connector. It would be a further benefit if the means for attaching the connector avoids the creation of entry points for moisture of areas that will retain moisture and lead to corrosion of the electrical components and connections of the socket or connector.

SUMMARY OF THE INVENTION

The present electrical connector comprises a standard J560-type receptacle or connector with a sealed, molded plastic unitary cover that extends over the length of the wire bundle and over the connector body to provide a moisture proof housing. The front of the connector is provided with surrounding collar that is separable into at least two segments, a detachable retaining clip segment and a non-detachable lip segment. The detachable retaining clip, when removed, reduces the overall dimension of the connector exterior to permit the insertion of the connector through a hole, void or opening in a trailer frame that is dimensioned to receive a SAE standard J560 connector therein. Once the non-detachable lip segment of the connector is inserted through the hole, void or opening in the trailer frame the retaining clip may be reattached to form a collar to retain and secure the connector within the a hole, void or opening and to the trailer frame.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENT

As required, detailed embodiments of the present inventions are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
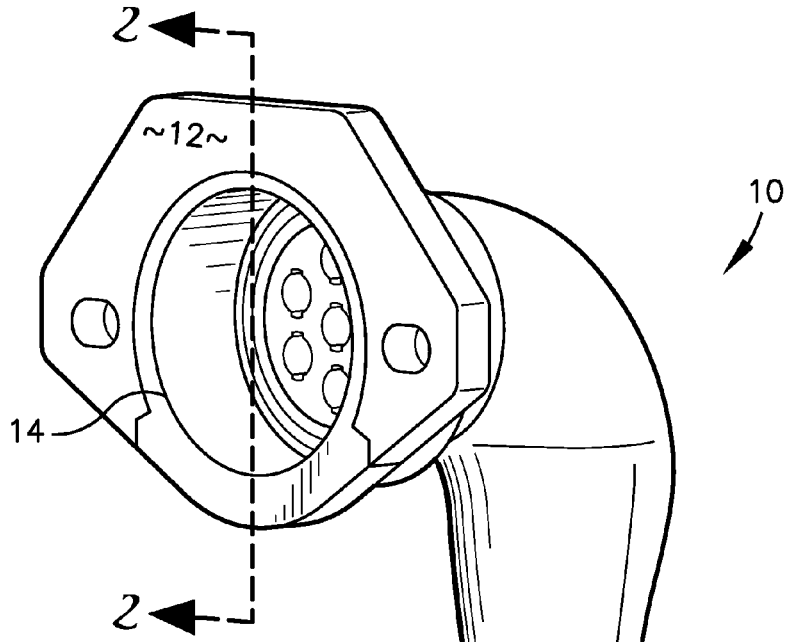
FIG. 1 shows a front and right side perspective view of the assembled electrical connector having the retainer clip 12 in position on the connector body to form a collar.

Referring now to FIG. 1, electrical connector 10 is shown completely assembled but not shown installed as it would be for use in a structure requiring an electrical connector. Electrical connector 10 is generally comprised of a retainer clip 12 which connects to a connector body 14 with the retainer clip 12 being removable and installable as needed to permit insertion of connector body 14 through an aperture or hole in a structure such as a truck trailer.

Figure 10:
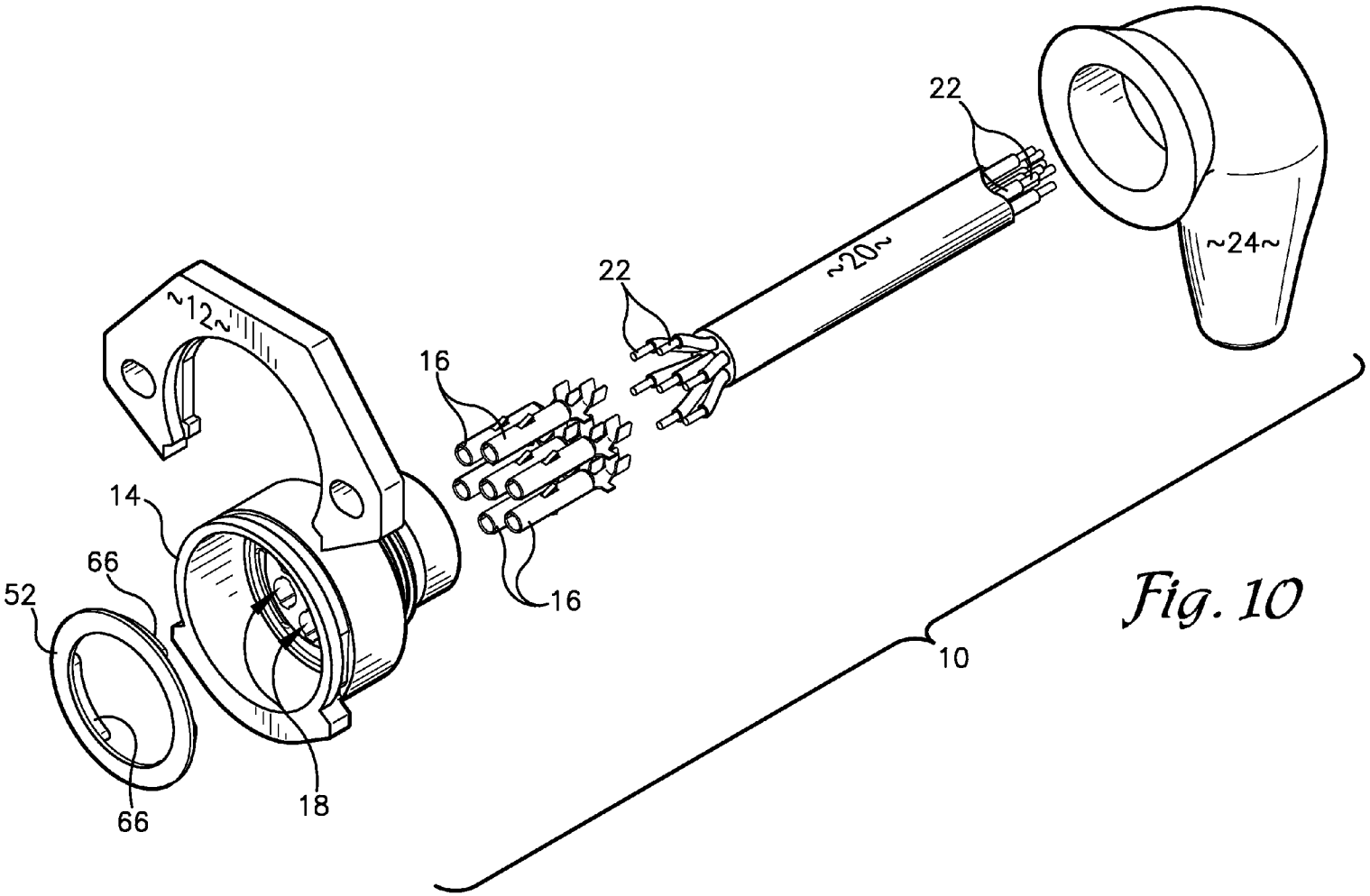
FIG. 10 shows a front and right side exploded view of electrical connector 10 and also showing connector seal 52 which is formed simultaneously with the formation of over-mold cable retainer 24 as plastic material forming over-mold cable retainer 24 is forced through access voids 48 in connector body 14.

Referring now to FIG. 10, the component parts of electrical connector 10 and their relationships to one another will be described. In FIG. 10, electrical connector 10 is shown in an exploded view. Connector clip 12 is shown space above the position it connects to on connector body 14. Terminals 16 are shown just prior to their insertion into terminal apertures 18 of connector body 14. A wiring harness 20 having conductors 22 is shown in position for connection to terminals 16. Over-mold cable retainer 24 is shown removed from connector body 14 and connector seal 52 is shown separated from connector body 14. It will be appreciated by those skilled in the art that after the assembly of wiring harness and conductors 22 to terminal 16 and the insertion of terminal 16 into connector body 14 that a liquid plastic material is then injected into a mold form containing the connector body and the terminals and the wiring harness. A liquid plastic material is injected to form the shape of over-mold cable retainer 24. During the formation process of over-mold cable retainer 24, a portion of the injected liquid plastic is allowed to pass through access voids 48 in connector body 14 (best seen in FIG. 5) to provide the formation of connector seal 52 simultaneously with the formation of over-mold cable retainer 24. Therefore a simultaneously molded unitary structure comprised of over-mold cable retainer 24 and connector seal 52 is constructed. It will be appreciated by those skilled in the art that the presence of connector seal 52 prevents moisture and debris from coming in contact with the terminals of electrical connector 10 when a complementary male connector is inserted into the female electrical connector 10 shown in the present embodiment.

Figure 2:
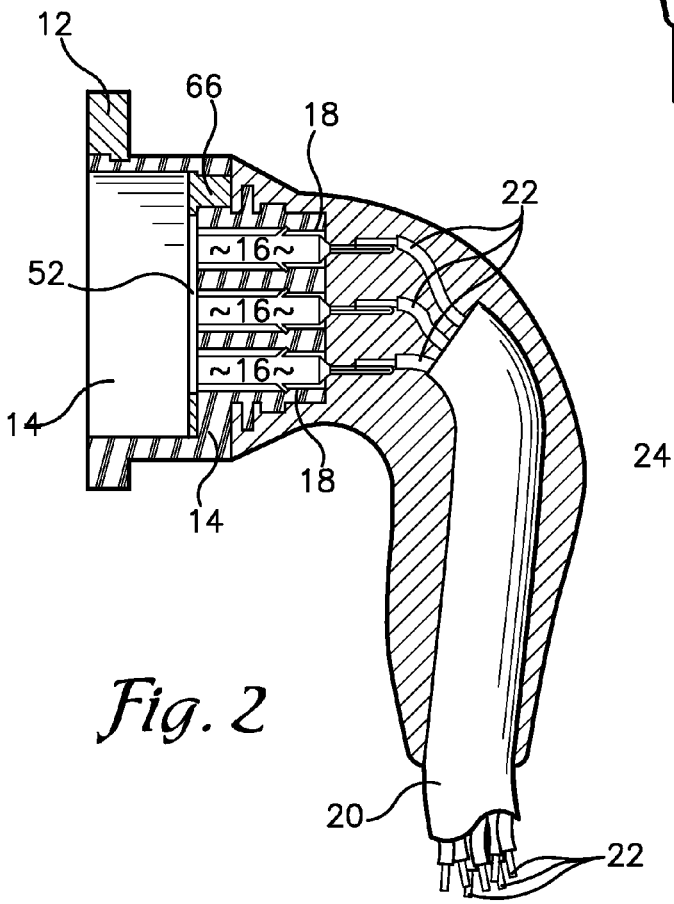
FIG. 2 is a cross-section view taken along line 2-2 of FIG. 1 and showing retainer clip 12 in position on connector body 14 with terminals 16 inserted into apertures 18 of connector body 14 and showing a wiring harness 20 having conductors 22 extending therefrom and connecting with terminals 16 surrounding wiring harness 20 and connector body 14 is over-mold cable retainer 24.
Figure 8:
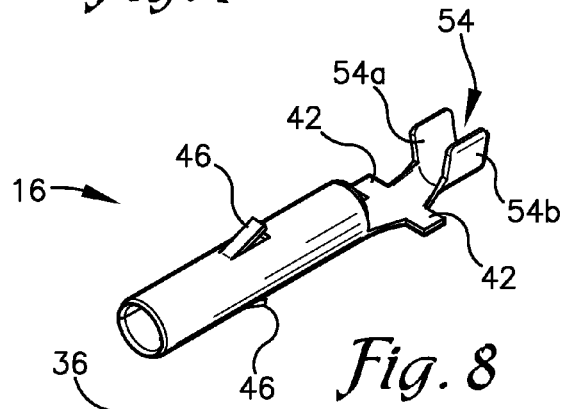
FIG. 8 shows a front top and right side perspective view of terminal 16.

Referring now to FIG. 2, the construction of electrical connector 10 is shown in cross-section view wherein it may be seen that terminals 16 are inserted into apertures 18 which are provided within connector body 14. As will be discussed hereinafter, terminal 16 are securely mounted within apertures 18 and structures are present to prevent both rotation of 16 within apertures 18 and the rearward movement of terminals 16 out of apertures 18 after the insertion of terminal 16 into the back end or rear of connector body 14. It is shown in FIG. 2 that conductors 22 are connected to terminal 16 with such connection being made by soldering or welding connectors 22 to the surface of a flat spade extension from the rear of terminal 16, or alternatively, conductor 22 may be crimped into connection with terminal 16 using a crimp connection 54 as is shown in FIG. 8.

Still referring to FIG. 2, conductors 22 are contained within wiring harness 20 which serves to maintain the seven conductors of the present embodiment in a single manageable group. Retainer clip 12 is shown in position on connector body 14 in FIG. 2 and the entirety of connector body 14 having terminal 16 therein with conductors 22 connected thereto and the wiring harness grouping of conductors 22 all being surrounded by the plastic of over-mold cable retainer 24 as a result of the injection molding process to produce over-molding cable retainer 24 and connector seal 52.

Figure 3:
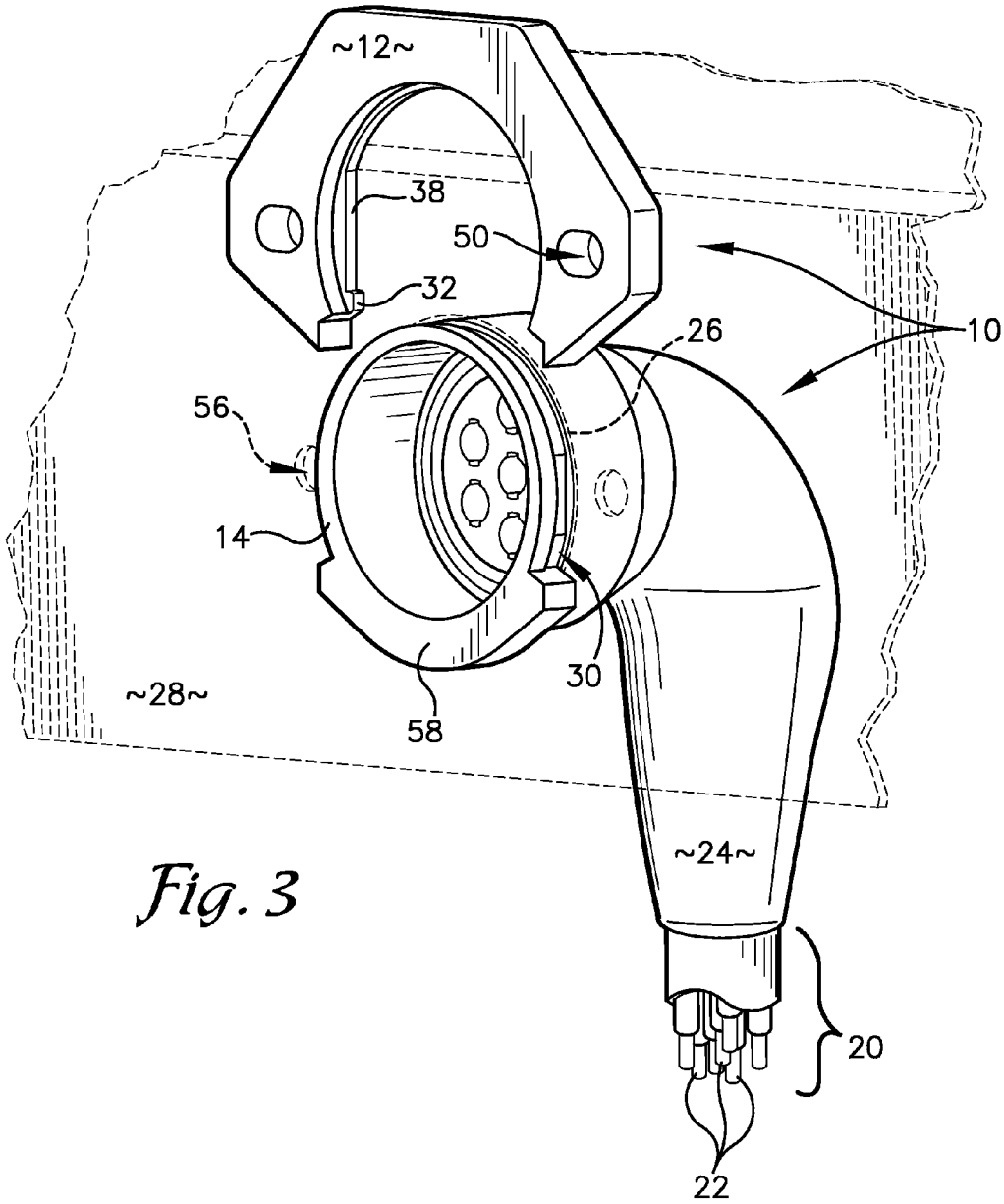
FIG. 3 is a front and right side perspective view of electrical connector 10 in a partially exploded view showing retainer clip 12 separated from connector body 14 and showing electrical connector 10 in an installed environment in which a void or hole 26 is provided in a work piece 28 and connector body 14 is passed through void 26 to then allow installation of retainer clip 12 on the opposite side of the bulkhead from cable retainer 24.

Referring now to FIG. 3, the method of use and installation of electrical connector 10 will be described. One typical use of electrical connector 10 is to install the electrical connector into a pre-existing wall or bulkhead of a vehicle such as a truck trailer. In a typical application, electrical connectors of the type to which electrical connector 10 belongs are installed in tandem tractor-trailer configurations wherein power and signal light and brake light connections must be communicated from a first trailer to a second trailer. In view of the long length of the wiring harnesses used in such an application and the need to have a weather resistant cable connection it is advantageous to avoid feeding a long length of wiring harness through an aperture. Also, it is advantageous to avoid disassembly of the electrical connector to install it on the vehicle or bulkhead or workpiece involved. The reason for this will be apparent to those skilled in the art. The feeding of long lengths of wiring harness through apertures can result in the scraping of the covering of the wiring harness and potential cutting of the wiring harness and insulating material around conductors thereby compromising the integrity of the wiring harness. The assembly and disassembly of the electrical connector to permit its mounting on the vehicle or workpiece will compromise the weather resistant nature of the assembly such assembly and disassembly requires removable parts with connecting crevices which can permit the intrusion of dirt and moisture into the device thereby compromising the quality of the electrical connections. Therefore, the present structure is designed with these issues in mind to provide a complete sealed integrally formed structure which does not require assembly or disassembly of the electrical connector and related components for installation into the workpiece or vehicle. Further, the manner of installation avoids the need to feed the entire length of wiring harness through an aperture which may have sharp edges which could scrape and cut and compromise the quality of the insulation on the conductors.

In FIG. 3, a workpiece or bulkhead or vehicle surface 28 is shown in broken lines indicating it to be environmental structure. Also is shown a void or hole or aperture 26 in the workpiece which is sized to permit the passage of connector body 14 of electrical connector 10 there-through once retaining clip 12 has been removed from connector body 14. Also shown in FIG. 3 are secondary voids 56, which permit insertion of a fastener therethrough to enable securing of electrical connector 10 to bulkhead 28 once installation and assembly of electrical connector 10 is complete. Upon insertion of electrical connector 10 (without retaining clip 12) through void 26 in bulkhead 28, lip 58 extending downwardly from the bottom of connector body 14 becomes positioned on the opposite side of the void 26 from the remainder of connector body 14. Lip 58 serves to properly orient connector body within void 26 to position the structures of connector body 14 which connectably mate with retaining clip 12 on the outside of the void 26. It will be noted that for purposes of this description, the location "outside the void" will be taken to mean on a first side of the bulkhead 28 in which the void 26 is established and the phrase "inside the void" will mean the position on a second side of bulkhead 28. Upon seating of lip 58 outside void 26, and on a first side of bulkhead 28, it will be possible to connect retainer clip 12 to those portions of connector body 14, which also are positioned outside of void 26 by the seating of lip 58 against bulkhead 28 outside of void 26. These additional parts and features of connector body 14 will be described hereinafter in detail, but they generally can be described as those features of connector body 14 which are adapted to receive therein retainer clip 12 and to mate with structures on retaining clip 12 to seat and lock retainer clip 12 to connector body 14 and thereby to seat and lock electrical connector 10 within void 26 on bulkhead 28 with certain features of electrical connector 10 outside void 26 and certain features of electrical connector 10 inside void 26.

As may be seen in FIG. 3, the features that are generally inside void 26 on a second side of bulkhead 28 are over-mold cable retainer 24 and wiring harness 20 and conductors 22 and terminal 16 and terminal apertures 18 and the features that are outside void 26, on a first side of bulkhead 28, are retaining clip 12, lip 58, seating trough 36, cavity 30 and shoulder 34 of lip 58. Once connector body 14 has been positioned as previously described in void 26, bulkhead 28 and retaining clip 12 is attached to connector body 14, the resultant structure will appear as is shown in FIG. 1 (however FIG. 1 does not show the environmental structure of FIG. 3). It will be appreciated by those skilled in the art that securing apertures 50 of retaining clip 12 align with secondary voids 56 of bulkhead 28 to permit passage of a fastener therethrough to complete the installation of electrical connector 10 on bulkhead 28 of a vehicle or trailer or other structure.

Figure 9:
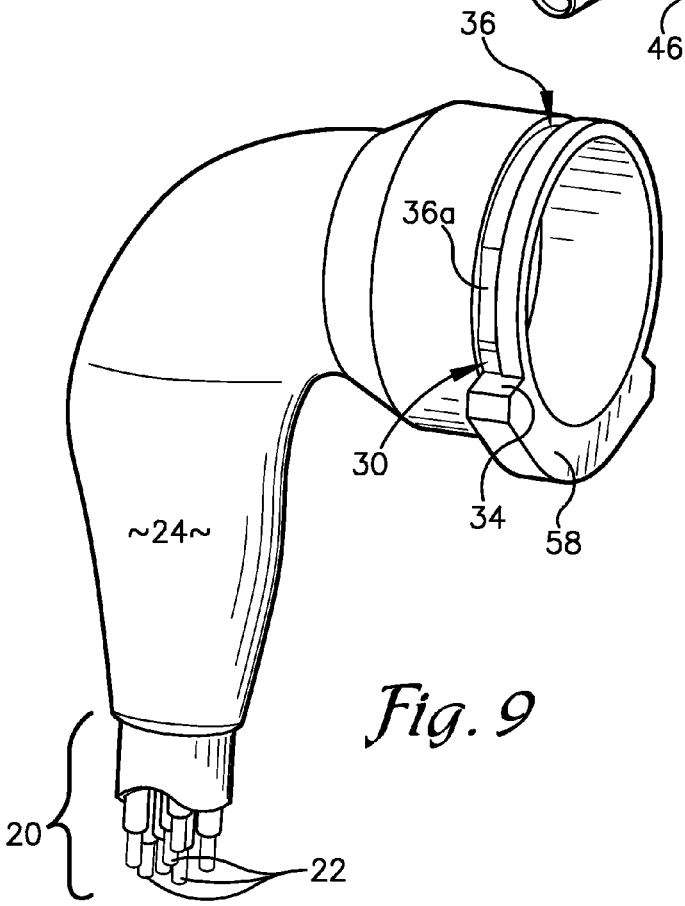
FIG. 9 shows a front and left side perspective view of electrical connector 10 with retaining clip 12 removed.

Still referring to FIG. 3, it now can be appreciated that the structure shown in FIG. 9 are those portions of electrical connector 10 which are manipulated as a unit for insertion through void 26 in bulkhead 28. FIG. 9 also provides yet another view of shoulder 34 and cavity 30 and seating trough 36 which receive finger 32 and ridge 38 of retainer clip 12 and which serve to provide a positive connection between connector body 14 and retainer clip 12 and prevent retraction of connector body 14 back through void 26 in bulkhead 28 once retaining clip 12 is installed.

Figure 4:
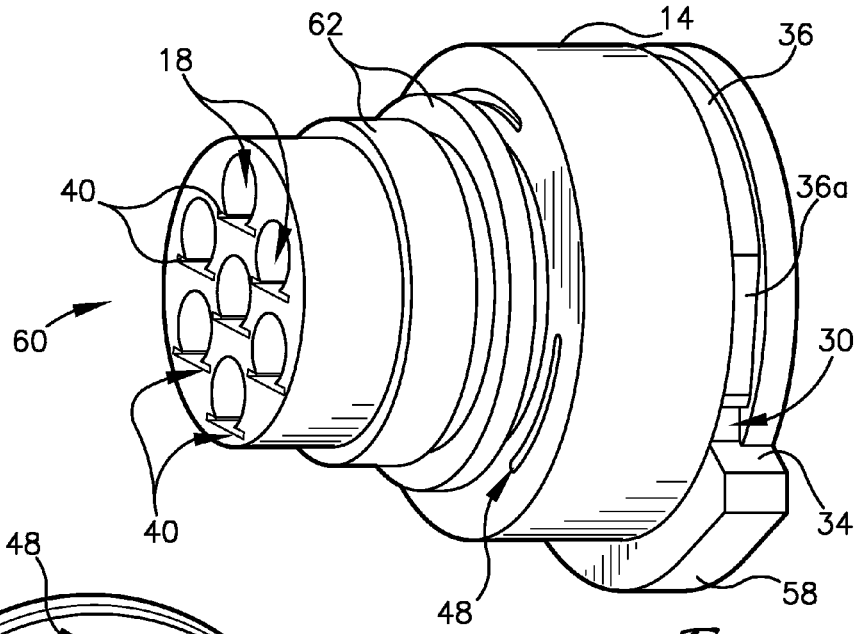
FIG. 4 shows a rear and left side perspective view of the connector body 14 of FIG. 1 with the terminals wiring harness retainer clip and cable retainer removed and showing the seven apertures 18 of one embodiment for receiving terminal 16 therein and showing cavity 30 on connector body 14, which receives finger 32 that projects from retainer clip 12 (see FIG. 3) and showing shoulder 34 which contacts retainer clip 12 to support retainer clip 12 and showing seating trough 36 on connector body 14, which receives ridge 38 of retaining clip 12 therein to assist in retaining connector body 14 within void 26 of bulkhead 28. Also shown are grooves 40 at the rear of apertures 18, which receive terminal retention tabs 42 of terminal 16 therein.
Figure 5:
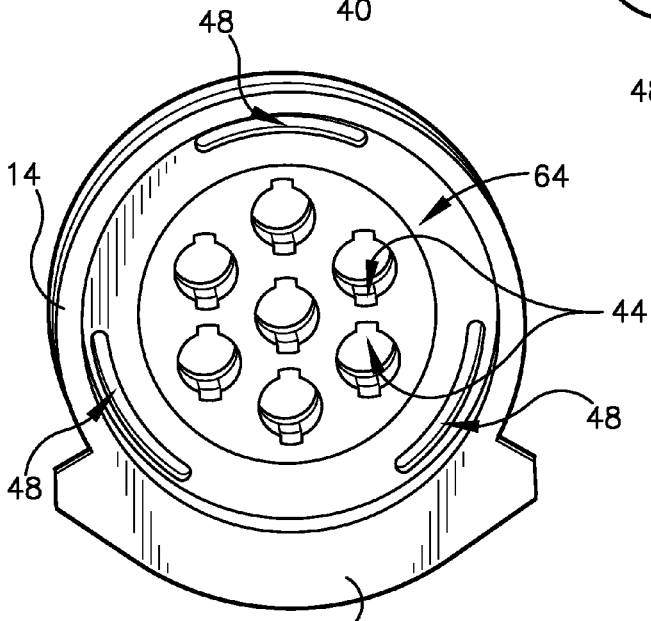
FIG. 5 shows a front elevation view of connector body 14 showing apertures 18 therein which receive terminals 16 and showing flange receivers 44 therein which receive spring flanges 46 of terminal 16 to prevent rearward movement of terminal 16 within connector body 14. Access voids 48 are shown which allow the plastic material that forms over-mold cable retainer 24 to flow through connector body 14 during formation of the over-mold cable retainer.

Referring now to FIGS. 4 and 5, the structure of connector body 14 will be described in additional detail. In FIG. 4 a first end 60 of connector 14 is shown having terminal apertures 18 therein. Terminal apertures 18 receive terminals 16 and secure terminals 16 within apertures 18 by grooves 40 which receive terminal retention tabs 42. The tabs 42 engage in grooves 40 and by such connection to connector body 14 eliminate any rotational movement of terminal 16 around the longitudinal axis of terminal 16. In this manner, rotational forces on the connection between terminal 16 and conductors 22 is provided and integrity of the soldering or crimping connection between conductors 22 and terminal 16 is enhanced. Also shown in FIG. 4 are two retaining ridges 62 which extend outwardly from the central longitudinal axis of connector body 14. It will be appreciated by those skilled in the art that these features operate to provide protrusions that are surrounded by the liquid plastic that is injected to form over-mold cable retainer 24. Protrusions 62 operate to assist in securing the connection between container body 14 and over-mold cable retainer 24 to prevent slippage and separation between container body 14 and over-mold cable retainer 24 after the formation of the cable retainer. This is of particular importance as these features are adjacent to access voids 48 in container body 14 which allow the flow of liquid plastic material therethrough to permit the formation of connector seal 52 within the receptacle area 64 of container body 14.

Still referring to FIG. 5, the front of terminal apertures 18 is shown. Flange receivers 44 are positioned in terminal apertures 18. Flange receivers 44 are provided to capture therein spring flanges 46 which extend from terminal 16. It can be appreciated by those skilled in the art that upon insertion of terminal 16 into apertures 18 of connector body 14 that spring flanges 46 become slightly depressed as they move through terminal apertures 18. Upon coming into contact with flange receivers 44 which are larger than the general diameter of terminal apertures 18, spring flanges 46 can return to their original position and become captured within receivers 44. This capture of spring flanges 46 within flange receivers 44 operates to prevent the subsequent rearward withdrawal of terminal 16 from engagement with terminal apertures 18. In this manner rearward directed stresses transmitted via wiring harness 20 and/or over-mold cable retainer 24 to the connection of terminal 16 within terminal apertures 18 is resisted and the integrity of electrical connector 10 is enhanced.

Figure 6:
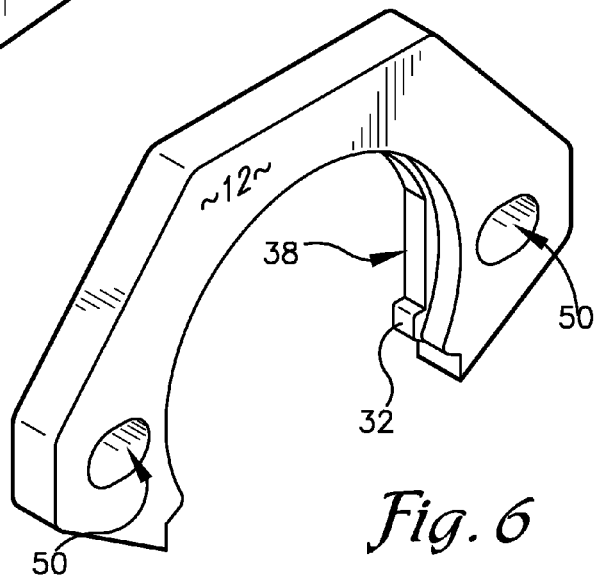
FIG. 6 shows a front top and left side perspective view of retainer clip 12 with securing apertures 50 therein.
Figure 7:
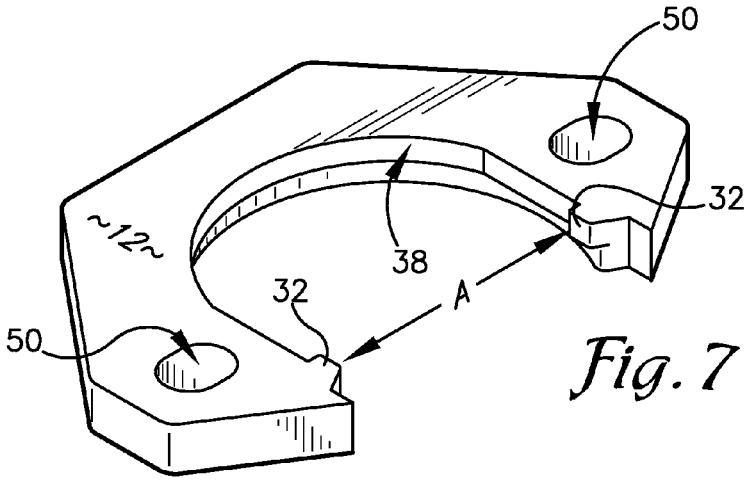
FIG. 7 shows a rear bottom and right side perspective view of retainer clip 12.

Referring now to FIGS. 6 and 7, retainer clip 12 will be more fully described. In FIG. 6, retaining clip 12 is shown having securing apertures 50 extending therethrough to permit the passage of fasteners therethrough for the securing of electrical connector 10 onto a workpiece 28 or bulkhead of a truck 28 after assembly of retaining clip 12 onto connector body 14 has been completed. Retaining clip 12 is provided with ridge 38 which extends from retaining clip 12 for connection into seating trough 36 of connector body 14 (FIG. 4). It will be appreciated by those skilled in the art that ridge 38 fits into seating trough 36 and therefore separate forward motion or rearward motion of retaining clip 12 with respect to connector body 14 is inhibited. Also shown in FIG. 6 is finger 32 which projects outwardly from ridge 38 and which is intended for reception within cavity 30 on connector body 14. As cavity 30 is a further intrusion into the surface of connector body 14 as compared to the distance of intrusion provided by seating trough 36, it will be appreciated that as connector clip 12 is guided into seating trough 36 of connector body 14 that finger 32 rides along flat segment 36A of seating trough 36 after which finger 32 of retaining clip 12 is forced into cavity 30 on connector body 14 by retaining clip 12. This forcing of finger 32 into cavity 30 is achieved as the insertion of retaining clip 12 into seating trough 36 causes an outward expanding forced to be delivered to retaining clip 12 as it passes along the track created by seating trough 36 and flat segment 36A. Upon finger 32 reaching cavity 30, finger 32 is pressed inwardly to relieve the outward, expansive pressure that has been delivered to retaining clip 12 by movement past the diameter of connector body 14. The forces involved here are generated by the presence of a finger 32 on each side of retainer clip 12 thus providing of opposed fingers 32 on either side of retaining clip 12 (best seen in FIG. 7). This gap between fingers 32 as indicated by Arrow A is narrower than the diameter of flat segments 36A on either side of connector body 14. This different spacing therefore causes the slight expansion of retaining clip A as it is inserted onto connector body 14 and results in the inward movement of fingers 32 into cavities 30 of connector body A to positively capture retaining clip 12 on connector body 14. As previously described, once retaining clip 12 is seated and captured by connector body 14, fasteners may be passed through securing apertures 50 and through workpiece 28 to secure electrical connector 10 to the workpiece.

Referring now to FIG. 8, terminal 16 will be described in greater detail. Terminal 16 is formed of an electrically conductive material such as a metal and is provided with spring flanges 46, which are captured within flange receivers 44 of connector body 14. Terminal 16 also is provided with terminal retention tabs 42 which, upon installation of terminal 16 within connector body 14, become inserted into grooves 40 to prevent pull out of terminal 16 within terminal apertures 18 of connector body 14. As previously described, the function of spring flanges 46 is to provide a positive capture of spring flanges 46 within flange receivers 44 and to thereby prevent the withdrawal of terminals 16 from terminal apertures 18 of connector body 14. In FIG. 8, the embodiment of terminal 16 is shown with a crimp connection 54 which has first and second legs 54A and 54B which receive conductor 22 therebetween upon which legs 54A can be pressed against conductor 22 to capture conductor 22 therebetween for positive electrical connection.

Once the connector system is securely attached to the trailer, a power cord can be connected to a forward mounted J560 connector to provide trailer power from the tractor power. Alternatively a power cord can be attached to a rear mounted J560 connector to provide power to tandem trailer or converter dolly.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the invention is by way of example, and the scope of the invention is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive electrical connector is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

Having thus described the invention what is claimed as new and desired to be secured by Letters Patent is as follows:

1. A electrical connector for attachment to a workpiece (28) the workpiece having a void (26) therein to receive the electrical connector therethrough, said electrical connector (10) comprising:

a connector body (14) having a plurality of voids (18) therein, a terminal (16) for insertion into each of said plurality of voids (18), said terminal being generally tubular and adapted to receive therein a male electrical connector, said terminal (16) having a spring clip (46) extending therefrom for connection to said connector body (14) for capture of said terminal (16) within said connector body (14), a lip (58) extending from said connector body (14), said lip (58) being engageable with a surface of the workpiece (28) adjacent the void (26) to retain said connector body within said void and against said workpiece, and a retainer clip (12) engageable with said lip (58) and said connector body (14) by insertion of a finger (32) into a cavity (30) on said connector body (14) whereby said lip (58) and said retainer clip (12) form a retainer collar for retaining said electrical connector within said void (26) of said workpiece (28).

2. The electrical connector as claimed in claim 1 further comprising a groove in said connector body and a ridge extending from said retainer clip said ridge being mateable with said groove to reduce frontward and rearward motion of said connector with respect to said workpiece.

3. An improvement in a housing system for containing an electrical connector and for attaching the connector and housing to a workpiece, the connector housing being configured to be received within an opening or void or hole in a workpiece such as a semi-trailer frame and secured there to, the improvement comprising:

a lip (58) extending from a front edge of said connector body (14), said lip (58) being engageable with an edge of the workpiece (28) adjacent a void (26) to retain the connector body within the void, and a retainer clip (12) engageable with said lip and said connector body (14) by insertion of a finger (32) into a cavity (30) on said connector body (14) whereby said lip (58) and said retainer clip (12) form a retainer collar for retaining said electrical connector within said void (26) of said workpiece (28).

4. The improvement as claimed in claim 3 further comprising a groove in said connector body and a ridge extending from said retainer clip said ridge being mateable with said groove to reduce frontward and rearward motion of said connector with respect to said workpiece.

5. A method of installing an electrical connector on a vehicle, said vehicle having a surface thereon presenting a hole or void therethrough wherein said void or hole is accessible from both sides for performing the installation of the electrical connector, the surface having a first interior side and a second exterior side, the method comprising:

providing an electrical connector having an electrical connector body and a lip (58) extending from a front surface of the connector body (14), the lip (58) being engageable with an edge of the workpiece (28) wherein said edge defines a portion of the boundary of a void (26) in the workpiece approaching the void with the electrical connector from the first interior side of the surface, inserting said connector body within the void in the surface to position said lip on the second exterior side, providing a retaining clip, attaching the retaining clip to the connector body and to the lip to form a collar on the second side of the workpiece, and attaching the connector body to the workpiece by securing the formed collar to the workpiece.

6. The method as claimed in claim 5 wherein said connector is secured to the workpiece by passing at least one fastener through the formed collar and through the workpiece.

7. The method as claimed in claim 5 wherein said connector is secured to the workpiece by an adhesive applied to the formed collar and the workpiece.

* * * * *